United States Patent [19]

Hanson et al.

[11] 3,952,539

[45] Apr. 27, 1976

[54] WATER TRAY FOR CLEAR ICE MAKER

[75] Inventors: Robert S. Hanson, 159 Marbrook Drive, Kettering; Cecil C. Pugh, 1210 Claybourne Road, Dayton, both of Ohio 45429

[73] Assignee: General Motors Corporation, Detroit, Mich.

[22] Filed: Nov. 18, 1974

[21] Appl. No.: 524,974

[52] U.S. Cl. ..... 62/351

[51] Int. Cl.[2] ..... F25C 5/08

[58] Field of Search ..... 62/351; 219/406, 407, 219/439, 385–387

[56] References Cited

UNITED STATES PATENTS

| | | | |
|---|---|---|---|
| 1,823,187 | 9/1931 | Buchanon et al. | 62/351 X |
| 1,852,064 | 4/1932 | Rosenberg | 62/351 X |
| 1,977,608 | 10/1934 | Blystone | 62/351 X |
| 2,061,891 | 11/1936 | Bohannon et al. | 62/351 X |
| 2,069,567 | 2/1937 | White | 62/351 X |
| 2,459,168 | 1/1949 | Jocelyn | 249/120 |
| 3,407,619 | 10/1968 | Walker | 62/351 X |
| 3,775,992 | 12/1973 | Bright | 62/73 |

*Primary Examiner*—William E. Wayner
*Assistant Examiner*—William E. Tapolcai, Jr.
*Attorney, Agent, or Firm*—Edward P. Barthel

[57] ABSTRACT

A clear ice maker has an improved stationary open-top water tray comprising a plastic frame with metal inserts in the tray side, end and bottom walls for containing a predetermined quantity of water. The tray receives a removable grid having a plurality of open-bottom, open-top ice mold cavities and flexible filler means between the cavities to displace substantially all of the water into the cavities when the grid is in the tray. The tray side and end metal inserts have heaters thereon which are activated prior to ice harvest to melt the ice bond between the grid and tray permitting release of the grid. The tray bottom wall metal insert has continuously energized heater means thereon and is formed to provide a raised area beneath each grid cavity, thereby preventing freezing through the bottom of the grid cavities.

2 Claims, 3 Drawing Figures

WATER TRAY FOR CLEAR ICE MAKER

This invention relates to an improved apparatus for making clear ice and, more particularly, to such apparatus for domestic refrigerators.

The U.S. Pat. No. 3,775,992, issued Dec. 4, 1973 to J. A. Bright, and assigned to the assignee of the instant application, discloses a clear ice maker having a stationary open top tray containing a predetermined quantity of water. A grid having a plurality of open bottom, open top ice mold cavities is rotatably inserted in the tray such that it displaces substantially all the water into the cavities. The patented ice maker further includes means for heating the side and bottom walls of the tray to keep the water adjacent thereto from freezing while below freezing air is directed over the open top of the tray and grid to freeze water into clear ice cubes starting at the interface between the air and the water in the cavities and continuing downwardly toward the bottom wall of the tray.

It is an object of the present invention to provide an improved water tray heating arrangement for use with an automatic clear ice maker which requires the periodic removal of the grid out of the tray upon clear ice cubes being formed in the grid cavities.

It is another object of this invention to provide an improved composite plastic and metal heated tray structure for an automatic clear ice maker for receiving a removable grid having a plurality of open-bottom, open-top ice mold cavities and flexible plastic filler material between the cavities. The tray includes a plastic frame with apertured side, end and bottom walls for the reception therein of metal inserts having heaters thereon whereby the side and end wall heaters are activated prior to each ice harvest cycle to melt the ice bond between the grid and tray while the tray bottom wall metal insert is formed to provide a raised dome-like portion beneath each grid cavity with the dome-like portions having continuously energized heaters thereon to prevent freezing of the water in the bottom of the grid cavities.

These and other objects and advantages of the present invention will be apparent from the following description, reference being had to the accompanying drawings wherein a preferred embodiment of the present invention is clearly shown.

In the Drawings:

FIG. 1 is a front elevational view, partly in section, of the freezer compartment of a domestic refrigerator showing in front elevation the automatic clear ice maker incorporating the water tray of this invention;

Figure 2:
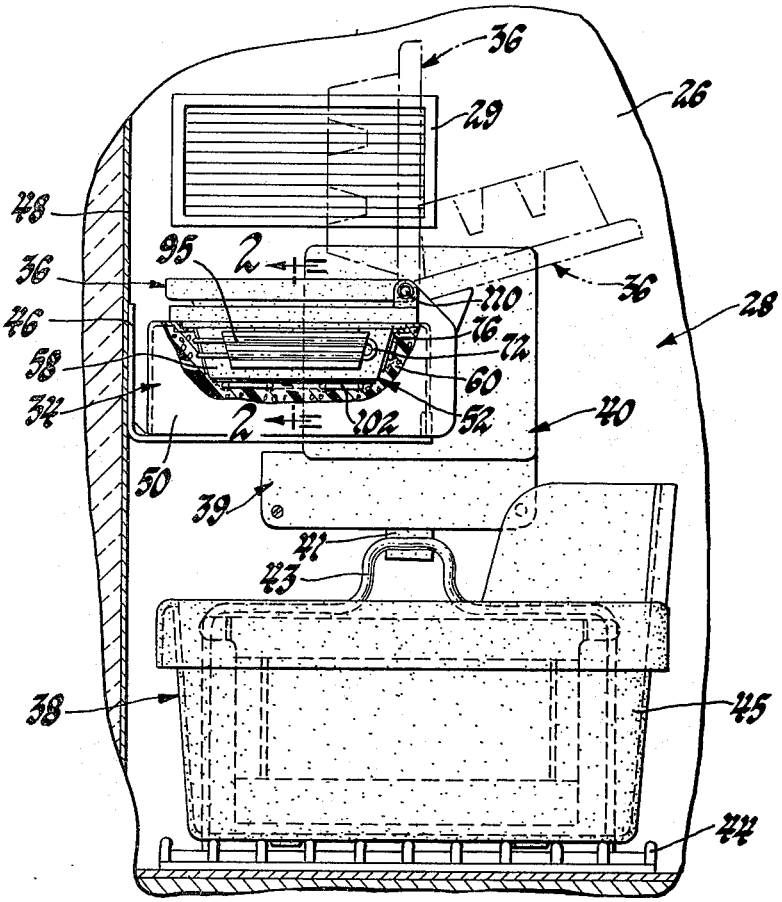
FIG. 2 is a sectional view taken along the line 2—2 of FIG. 1, showing the tray heating arrangement together with the inserted grid.
Figure 2:
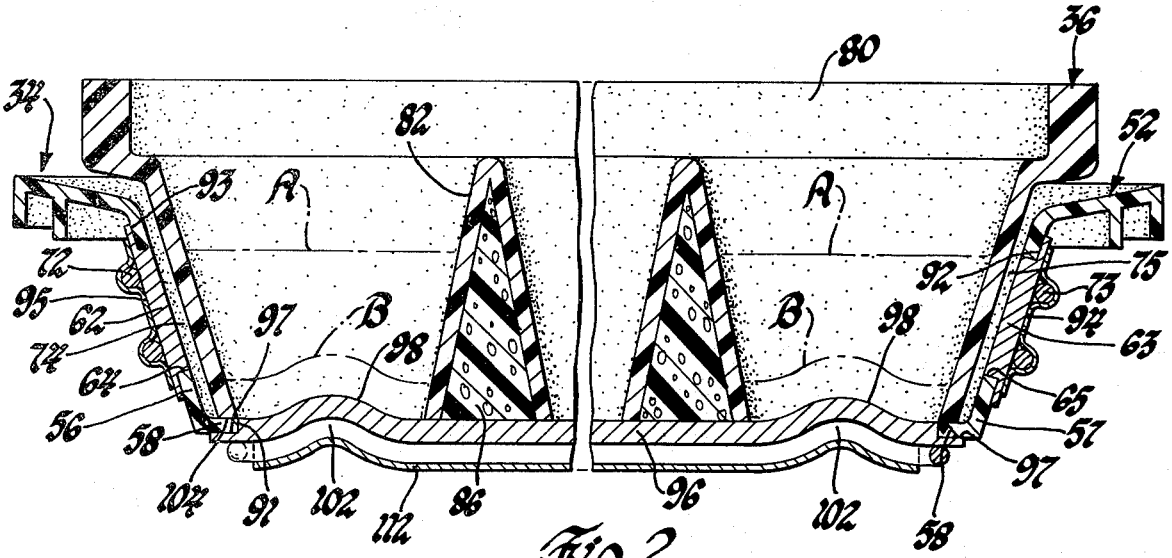

In accordance with the teachings of this invention a clear ice maker 28 is shown in FIG. 1 in a freezer portion 26 of a domestic refrigerator having a louvered duct 29 on the back wall which distributes a quantity of below-freezing air to the ice maker as shown and described in the above-mentioned U.S. Pat. No. 3,775,992 to Bright, the disclosure of which is incorporated by reference herein. As disclosed in the Bright patent, the ice maker includes a tray and heater assembly 34, an ice cube grid 36, an ice storage bucket assembly 38, a weight sensing means 39 for the bucket and ice, an ice harvesting mechanism 40, and a water fill system, a portion of the fill tube being shown at 37 in communication with the tray assembly 34.

Figure 3:
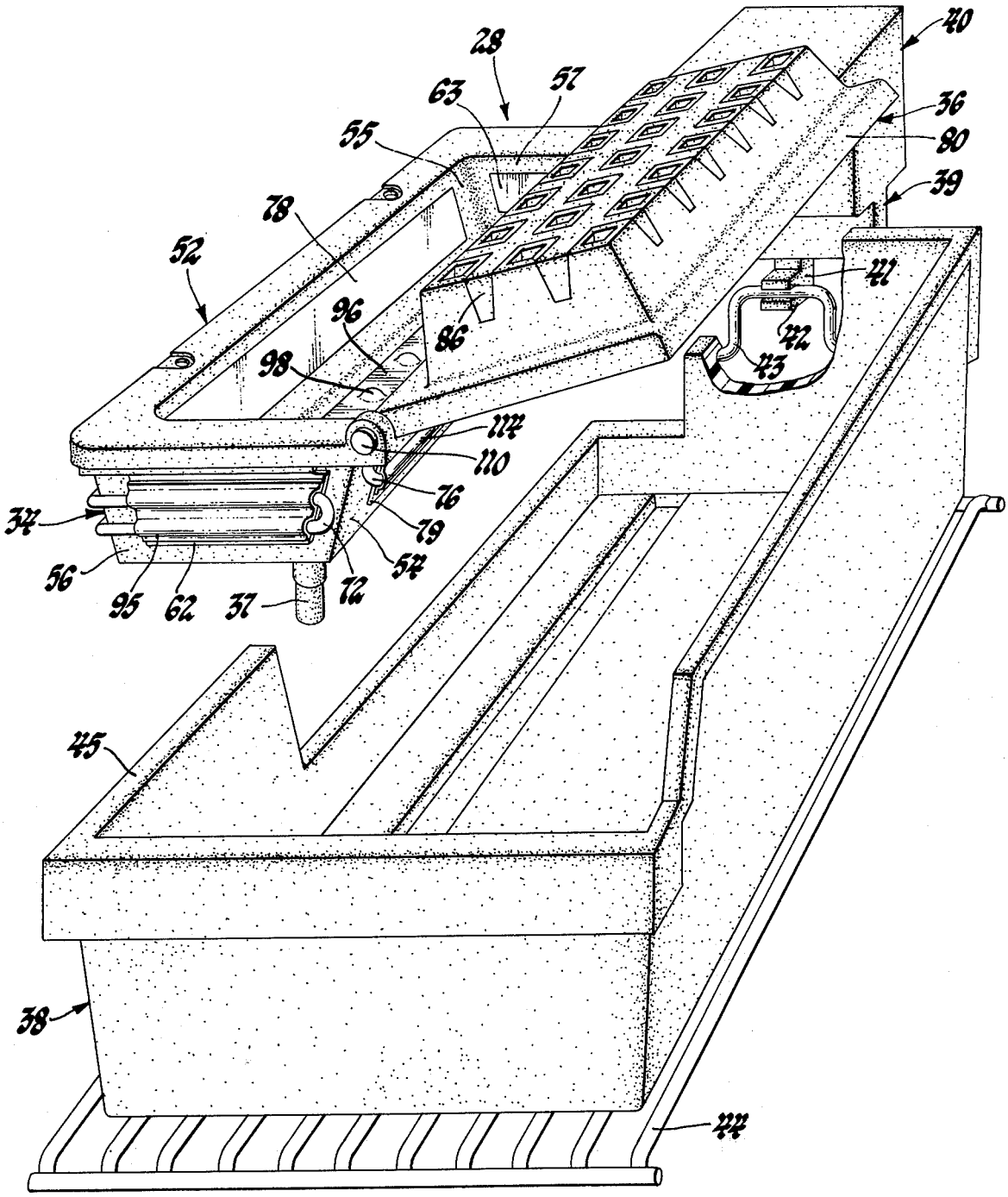
FIG. 3 is a perspective view of the clear ice maker in an ice harvesting mode showing the improved water tray of this invention.

As seen in FIG. 3, the weight-sensing means includes a nylon weigh shaft 41 having a hooked portion 42 for gripping a loop in an upright shelf bracket 43 supporting the rear of steel wire shelf 44 supporting ice container 45 formed of high impact polystyrene.

The tray and heater assembly 34, shown in FIG. 1, supported by a bracket means 46 from a side wall 48 of the freezer compartment 26, includes a drawn sheet metal housing 50 forming on the inner side thereof a water containing composite plastic frame and metal insert tray generally indicated at 52 having plastic side wall flange borders 54 and 55, end wall flange borders 56 and 57 and a bottom wall flange border 58. Intermediate the outer metal housing 50 and the inner composite tray 52 a cavity is provided packed with Freon-filled urethane foam insulation 60. As seen in FIG. 2, the tray fore and aft end wall flange borders 56 and 57 respectively, are identical and include metallic inserts in the form of rectangular aluminum plates 62 and 63 located in window-like elongated rectangular openings 64 and 65 respectively, for the reception of the plate inserts. With reference to FIG. 3, it will be noted that the side wall plate insert 78 extends substantially the entire length of the composite tray horizontal portion of its side wall border 55 and over one-half the height of the vertical portion of its side wall border so as to project vertically from the water level or ice upper surface indicated by letter A to the maximum ice cube lower upwardly concave or dome-like surface indicated by letter B. The composite tray side walls are identical with the tray end walls except for their greater horizontal width dimension and therefore a discussion of the end walls 62 and 63 will suffice.

FIG. 2 shows the end wall inserts 62 and 63 with paired horizontally extending heating wires 72 and 73 located thereon adapted for heating the end wall metal inserts 62 and 63 respectively, prior to each ice harvesting operation to melt the ice in their associated clearance slots 74 and 75 between the plastic ice cube grid 36 and the composite tray 52. In a like manner side wall heating wires are provided as shown at 76 for the right side wall insert plate 79 opposite left side wall plate 78.

The plastic grid 36 has characteristics of poor heat conduction and good flexibility at low temperature with good ice release and return memory. It is comprised of a polypropylene housing 80 defining cavities 82 for a plurality of ice cubes. Each cavity 82 has an inverted truncated pyrimidal shape. On the outside of the housing between the cavity forming portions thereof, a flexible filler 86 of RTV silicone rubber fills the space between the cube forming cavities on the outside of the grid 36. The filler material should have an anti-stick characteristic to aid in the release of the grid from the tray during ice harvesting. It should be sufficiently flexible to distribute forces throughout the grid when the grid is warped for harvesting cubes as shown in the above-mentioned Bright patent. Aside from these characteristics, the filler 86 serves to force water in the tray upwardly into the cube forming cavities of the grid. Thus, with the grid in place in the composite tray 52 (FIG. 1 solid line) the water will rise to level A.

As best seen in FIG. 2, the composite tray end wall metal insert plates 62 and 63 are identical and each has a thickness of about 1½ times the thickness of the tray side wall frame borders 54 and 55. In the preferred form the metal plates are about 0.09 inches and the plastic frame borders are about 0.06 inches. The peripheral edges of the end plates 62 and 63 are formed with undercut grooves 92 and 93 respectively, to provide a single lap-butt joint with the edges of the tray side wall openings 64 and 65. The plates 62, 63 are permanently fixed in the tray frame openings by a suitable cementing compound such as a resin cement.

Each of the heaters 72 and 73 are held in contact with their associated plates 62 and 63 by sheets of aluminum foil 94 and 95, preferably having a thickness of about 0.005 inches, the edges of which are sealed to the insert plates preferably by resin cement.

FIG. 2 shows bottom wall flange borders 58 forming a single bottom window opening 91 which receives a bottom insert plate 96 having a peripheral undercut groove 97 dimensioned to form a single sealed lap-butt joint with the edges of the bottom opening 91 in the same manner as the end wall plates 62 and 63. It will be noted that the bottom wall plate 96 extends outwardly a defined distance to insure that the bottom opening of the grid cavities 82 are completely exposed to the metal insert plate 96. The bottom plate is formed with a plurality of raised dome-like embossments or circular buttons 98 which are vertically aligned with each of the cavities 82 such that their apices substantially coincide with the principal axis of each truncated rectangular ice cube cavity.

The bottom insert plate 96 is provided with resistance wire heaters 102 for heating the plate 96 so as to expose the bottom side of the tray beneath the ice formed in the grid cavities to above-freezing temperature. This retains that portion of water along the bottom side of the tray in a liquid state which, as explained in the Bright patent, is critical to the formation of clear ice cubes. It was discovered, however, that in the Bright structure not only was the heating of the side and bottom walls of an all metal tray inefficient and wasteful of power in allowing the metal to provide a heat path to conduct away heat from the tray to the freezer compartment 26, but also caused a captured ice cube problem by virtue of the cubes forming outwardly directed peripheral ice flanges along the bottom edges 104 of the grid, locking the cubes in the grid when it is inverted.

Applicants' invention of a composite tray having a plastic frame provided with heated metal inserts 62, 63, 78, 79 and 96 achieved a more efficient warming arrangement which minimizes the amount of unwanted heat flow dissipated to the freezer compartment 26. This structure together with the bottom plate's upwardly convex or dome-like embossments 98 provide effective heat transfer upwardly into each grid cavity 82 such that the resultant bottom upwardly concave or dome-like surface B of the clear ice cubes being raised a sufficient height above the grid bottom edges 104 to prevent the formation of ice cube locking flanges along the lower wall portions of the cavities 82. Applicants thus insure against ice cube flanges forming under the grid bottom edges 104 with the resultant locking-up of each clear ice cube in its cavity preventing the harvesting of the cubes when the grid 36 is pivoted out of the tray about pivots 110 into its inverted position shown in FIG. 1. The warping or twisting harvesting operation of the grid is disclosed in the Bright U.S. Pat., No. 3,775,992. It will be noted in FIG. 2 that the bottom heating wires 102 extend longitudinally of the tray and are centered on the vertical axis of the cavities 82 and conform to the upward curvature of the domes 98 to provide maximum heat transfer to the center of each of the cavities at all times.

It will be noted that a sheet of aluminum foil 112 is employed to hold the heating wire 102 in contact with the bottom plate 96 and aluminum foil sheet 114 holding side wall heating wires 76 in contact with plate 79 in the same manner as the foil sheets 94 and 95 on the tray end wall heaters.

While the embodiment of the present invention as herein disclosed constitutes a preferred form, it is to be understood that other forms might be adopted.

We claim:

1. A clear ice maker in a freezer comprising a tray having side and bottom walls adapted to contain a body of water, a grid in said tray having cavity-forming means for displacing the body of water contained by said walls into the cavity, fan means distributing subfreezing air over the top planar surface of said body of water in said grid cavity for a sufficient period to initiate the freezing of clear ice in said grid cavity along the interface between said air and said top planar surface and to continue the freezing of clear ice downwardly in said grid cavity, and a bucket for storing said clear ice in said freezer and being removable from said freezer, heating means energizable to maintain said body of water in a liquid state adjacent said tray below the freezing clear ice, harvesting mechanism for removing said grid and clear ice from said tray before the freezing of clear ice downwardly in said grid cavity reaches the bottom wall of said tray and depositing said clear ice in said bucket, the improvement in said tray heating means comprising a composite tray having a plastic frame with side, end and bottom walls formed with window-like apertures therein, plate metal inserts positioned in said apertures, a first heater for said side and end wall inserts, a second heater for said bottom wall insert, said side and end wall metal inserts having a vertical dimension substantially coextensive with the clear ice cubes in said grid from their top planar surfaces to their lower surfaces, said first side wall heater operative to heat said side and end wall inserts, said second bottom wall heater operative to maintain said body of water below the freezing clear ice at an above freezing temperature, said bottom wall metal insert having a plurality of dome-like embossments formed in a grid-like pattern therein, whereby upon the grid being set down in said tray each grid cavity will be centered over an embossment such that heat will be transferred to the center of the clear ice cubes thereby forming a complementary concave bottom surface of the cubes preventing the cubes from forming peripheral flanges locking the cubes in said grid upon the inverting of said grid during the harvesting cycle of the ice maker.

2. A clear ice maker in a freezer comprising a tray having side and bottom walls adapted to contain a body of water, a grid in said tray having cavity-forming means for displacing the body of water contained by said walls into the cavity, fan means distributing subfreezing air over the top planar surface of said body of water in said grid cavity for a sufficient period to initiate the freezing of clear ice in said grid cavity along the interface between said air and said top planar surface and to continue the freezing of clear ice downwardly in said grid cavity, and a bucket for storing said clear ice in said freezer and being removable from said freezer, heating means energizable to maintain said body of water in a liquid state adjacent said tray below the freezing clear ice, harvesting mechanism for removing said grid and clear ice from said tray before the freezing of clear ice downwardly in said grid cavity reaches the bottom wall of said tray and depositing said clear ice in said bucket, the improvement in said tray heating means comprising a composite tray having a polypropylene plastic frame with side, end and bottom walls formed with window-like apertures therein, aluminum metal insert plates positioned in said apertures, said plates having a thickness of about one and one-half times the thickness of said tray plastic frame, said plate peripheral edges formed with undercut grooves to provide a single lap-butt sealed joint with the edges of the tray apertures, a first resistance heater for said side and end wall insert, a second heater for said bottom wall insert, said side and end wall metal inserts having a vertical dimension substantially coextensive with the clear ice cubes in said grid from said top planar surface to the lower surface of the clear ice cubes, said bottom wall insert of a dimension to be coextensive with the bottom openings of said grid cavities, said first side wall heater operative to heat said side and end wall inserts, and said second bottom wall heater operative to maintain said body of water beneath the freezing clear ice at an above freezing temperature.

* * * * *